US005231758A

United States Patent [19]

Schauer

[11] Patent Number: 5,231,758

[45] Date of Patent: Aug. 3, 1993

[54] PROCESS FOR PRODUCING AN ELECTRICAL CONNECTION BETWEEN TWO ELECTRIC LINES

[75] Inventor: Friederich Schauer, Heroldsberg, Fed. Rep. of Germany

[73] Assignee: Kabelmetal Electro GmbH, Fed. Rep. of Germany

[21] Appl. No.: 962,458

[22] Filed: Oct. 16, 1992

[30] Foreign Application Priority Data

Nov. 9, 1991 [DE] Fed. Rep. of Germany ..... 4136901

[51] Int. Cl.[5] ..... H01R 43/24

[52] U.S. Cl. ..... 29/856; 29/869; 29/872; 156/49; 439/492

[58] Field of Search ..... 29/856, 869, 872, 868, 29/855; 156/49; 174/84 R; 264/272.14, 272.15; 439/492; 228/179

[56] References Cited

U.S. PATENT DOCUMENTS 4,707,914 11/1987 Schauer ..... 29/869
4,710,593 12/1987 Hall, Jr. et al. ..... 29/868
4,949,454 8/1990 Schauer et al. ..... 439/492
4,952,256 8/1990 Schauer et al. ..... 156/49

FOREIGN PATENT DOCUMENTS 0335051 10/1989 European Pat. Off. .
3333709 6/1984 Fed. Rep. of Germany .
2591808 6/1987 France .
130397 3/1978 German Democratic Rep. .

*Primary Examiner*—P. W. Echols
*Assistant Examiner*—David P Bryant
*Attorney, Agent, or Firm*—Ware, Fressola, Van Der Sluys & Adolphson

[57] ABSTRACT

A process is indicated for producing an electrical connection between a ribbon line and a connecting line, which have at least two electrical conductors each. To relieve the strain on the conducting areas, the exposed ends of the conductors of both lines are placed in a support which is made of insulated material and is equipped with corresponding recesses. Subsequently, the conductors of the lines to be connected are soldered to each other. Finally, an insulation material cover, which adheres firmly to the support, is molded over the connections of the conductors and the ends of both lines.

4 Claims, 1 Drawing Sheet

PROCESS FOR PRODUCING AN ELECTRICAL CONNECTION BETWEEN TWO ELECTRIC LINES

BACKGROUND OF THE INVENTION

1. Technical Field

The invention is directed to a process for producing an electrical connection between a ribbon line and a connecting line, each containing at least two electric conductors, whereby the conductors of both lines are first exposed and then electrically connected, and whereby the connection of both lines is imbedded in a protective body made of insulation material.

2. Description of the Prior Art

Processes for connecting electric lines in various manners have been known for years. Problems do not normally occur if the conductors of the lines to be connected are rugged conductors. However, considerable difficulties arise if the conductors of one of the lines to be connected are flat conductors having relatively small thicknesses. Such flat conductors are mechanically very vulnerable and can easily be broken, especially, after the flat conductors have been electrically connected to the stable conductors of the connecting line and the established connection with its attached lines is transported and placed into an injection mold for molding the protective cover over the connection. Unless a great deal of care is used, buckling of the flat conductors at the outlet of the insulation can occur. Such buckling further weakens the flat conductors whereby they can easily tear or break when subjected to tensile stress. Such tensile stresses may be caused during molding of the protective body, by the high pressure material in the injection mold. However, tensile stresses may also be produced when the assembled device is later utilized, because of the conducting connection to the more rugged conductors. If the flat conductors are torn or damaged, a permanently loose connection results. In both instances, the entire arrangement becomes useless.

In the known process according to U.S. Pat. No. 4,952,256, to protect the flat conductors prior to connecting them to the rugged conductors configured as round conductors, a ring of insulation material is slipped over the round conductors, which is pressed by a die against the round conductors during the injection molding process. This secures the round conductors so that they are not moved by the injected molding material. Thus, the connections are protected against tensile stresses during the molding process. However, the cost of this process is relatively high. The ring that must be slipped over the conductors is an additional component and the injection mold must be equipped with at least one additional die. Furthermore, the connection between the conductors of both lines remains vulnerable to tensile stresses.

SUMMARY OF THE INVENTION

The present invention overcomes the problems of the prior art by establishing a permanently secure electrical connection between a line with flat conductors and a line with rugged conductors. This is accomplished by the invention in the following manner:

the exposed ends of the conductors of both lines are first placed in an insulated support equipped with corresponding recesses;

the conductors of both lines to be connected are then soldered to each other; and finally an insulation material cover, which adheres firmly to the support, is molded over the connections of the conductors and the ends of both lines.

This process provides a simple permanent strain relief for the vulnerable flat conductors. The strain relief is in place during the injection molding of the cover as the conductors to be connected are secured to the support by being placed into the recesses and by the heat generated during soldering. In addition, in the finished arrangement, the strain relief is permanently ensured by the cover, whose insulation material penetrates during the injection molding process into all remaining gaps between conductors and support, and, in particular, mechanically surrounds the enlarged connections caused by the soldering. Therefore, further tensile stresses occurring in the assembled conducting line cannot be transmitted to the flat conductors.

DETAILED DESCRIPTION OF THE INVENTION

Figure 1:
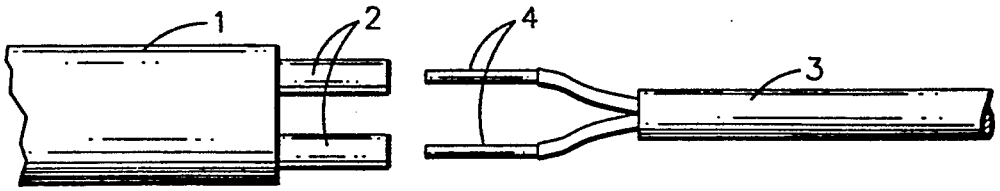
FIG. 1 shows the ends of two electric lines to be connected to each other.

Referring to FIG. 1, a ribbon line 1 used in the present invention has two flat conductors 2. A connecting line 3 has two round-shaped conductors 4 which have circular cross-sections. In accordance with the invention, the flat conductors 2 of the ribbon line 1 and the conductors 4 of the connecting line 3 will be electrically connected to each other.

Figure 2:
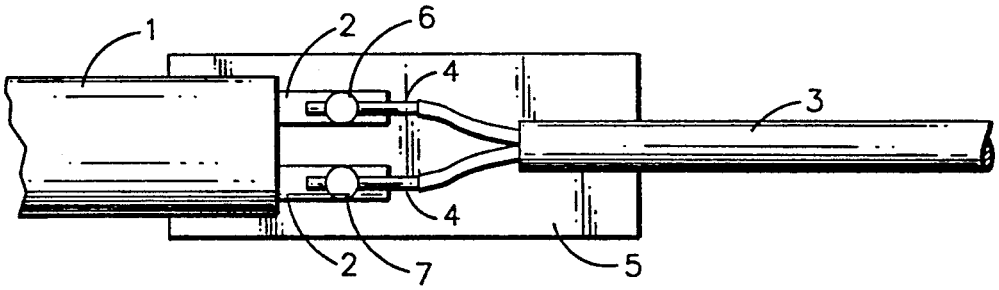
FIG. 2 is a top view of an uncovered connection.

To achieve the desired electrical connection, the conductors 2 and 4 of both lines 1 and 3 are first exposed through removal of their insulation and are cut to length. The ends of both lines 1 and 3 are then placed into a support 5 made of insulation material, which is equipped with corresponding recesses into which the ends of both lines 1 and 3, as well as the conductors 2 and 4, can be inserted and affixed in their proper positions. At this stage, they occupy the position shown in FIG. 2 with the conductors 4 overlapping the flat conductors 2. Conductors 2 and 4 are soldered to each other at these points resulting in connections 6 and 7.

After the connections 6 and 7 are finished, the two lines 1 and 3 are electrically connected to each other through their conductors 2 and 4. They are still in their proper positions in the support 5 and are relatively secured to the latter by the recesses on the one hand, and also by the heat generated during soldering, on the other. The heat slightly melts the material of the support 5 so that adhesion takes place in the joined areas between the conductors 2 and 4 and the support 5.

After the connections 6 and 7 have been completed, the support 5 with the attached lines 1 and 3 is placed into an injection mold (not shown), in which a cover 8 is molded to support 5. The insulation material of the cover 8 thereby penetrates into all recesses and gaps of the support 5, and fills them completely. The insulation material of the cover 8 is chosen so that it bonds firmly with the support 5. The support 5 may be equipped with protrusions and undercuts for better bonding of the insulation material of the cover 8.

Figure 3:
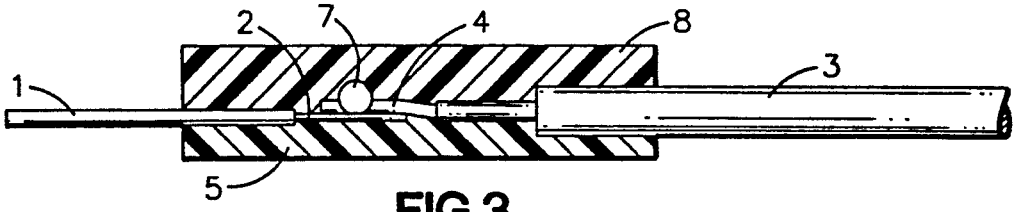
FIG. 3 is a cross sectional view of a connection established in accordance with the process of the invention.

As can be seen in FIG. 3, the connections 6 and 7 are enlarged by the soldering material creating an enlargement in each of those areas. A tensile stresses occurring in line 3, for example, can only be transmitted up to the enlargement. It does not affect the flat conductors 2 of the ribbon line 1.

As shown in FIG. 3, the cover 8 may be molded only to the support 5. However, it is also possible to at least partially mold the support 5 into the cover 8, or completely imbed it therein, insofar as such is permitted by the dimensions of the device into which the connection will be inserted. In any event, it must be ensured that the cover 8 is securely bonded to the support 5.

Thus, it can be seen from the foregoing specification and attached drawing that the present invention provides an effective means for establishing electrical contact between a ribbon line and a connecting line.

The preferred embodiment admirably achieves the objects of the present invention; however, it should be appreciated that departures can be made by those skilled in the art without departing from the spirit and scope of the invention which is limited only by the following claims.

What is claimed is:

1. A process for producing an electrical connection comprising the steps of:

(a) providing a ribbon line and a connecting line, each of which has at least two electrical conductors having ends prepared for electrical connection;

(b) providing a protective support made of insulation material, the protective support having recesses corresponding to the ribbon line and the connecting line;

(c) positioning the ends of each of said at least two electrical conductors of the ribbon line and the connecting line in the recesses;

(d) electrically connecting the ribbon line with the connecting line by soldering the ends of each of said at least two electrical conductors of the ribbon line and the connecting line; and (e) injection molding an insulation material cover on the protective support and the soldered ends of the ribbon line and the connecting line.

2. A process according to claim 1, wherein the protective support has protrusions and undercuts which are completely imbedded in the insulation material of the cover.

3. A process according to claim 1, wherein the insulation material cover is firmly adhered to the protective support.

4. A process according to claim 1, wherein at least a portion of the insulation material of the protective support melts during the electrical connecting step so that adhesion takes place between the insulation material and the soldered ends after resolidification of the melted insulation material.

* * * * *

UNITED STATES PATENT AND TRADEMARK OFFICE

CERTIFICATE OF CORRECTION

PATENT NO. : 5,231,758

DATED : August 3, 1993

INVENTOR(S) : FRIEDRICH SCHAUER

It is certified that error appears in the above-identified patent and that said Letters Patent is hereby corrected as shown below:

On the title page:
Item (75) Inventor:

"Friederich" should be --Friedrich--

Signed and Sealed this

Twenty-ninth Day of March, 1994

*Attest:*

Bruce Lehman

BRUCE LEHMAN

*Attesting Officer*

*Commissioner of Patents and Trademarks*